US005505330A

United States Patent [19]

Nunes

[11] Patent Number: 5,505,330

[45] Date of Patent: Apr. 9, 1996

[54] REUSABLE BEVERAGE CAN GRIP

[76] Inventor: James Nunes, 12129 Arrowhead Dr., Austin, Tex. 78727

[21] Appl. No.: 327,199

[22] Filed: Oct. 21, 1994

[51] Int. Cl.[6] ..... B65D 25/00

[52] U.S. Cl. ..... 220/742; 220/755; 220/759; 220/769; 248/312.1; 16/114 R

[58] Field of Search ..... 220/737, 741, 220/742, 755, 756, 759, 769; 248/310, 311.2, 312.1; 16/114 R; 294/27.1, 32, 33

[56] References Cited

U.S. PATENT DOCUMENTS

| | | | |
|---|---|---|---|
| 2,010,317 | 6/1934 | Olson . | |
| 2,424,094 | 9/1944 | Herr . | |
| 2,665,936 | 1/1954 | Moore . | |
| 2,838,202 | 6/1958 | Huether | 220/741 |
| 3,014,621 | 12/1961 | Povitz . | |
| 3,029,975 | 5/1960 | Aiello . | |
| 3,189,937 | 6/1965 | Sciortino . | |
| 3,825,151 | 7/1974 | Arnaud | 220/741 X |
| 4,127,915 | 12/1978 | Logan et al. . | |
| 4,602,723 | 7/1986 | DeMars | 220/742 |
| 4,898,297 | 2/1990 | Wheeler . | |
| 4,993,675 | 2/1991 | Walker | 248/311.2 |
| 5,054,638 | 10/1991 | Rose . | |
| 5,203,471 | 4/1993 | Widman | 220/755 |

*Primary Examiner*—Allan N. Shoap
*Assistant Examiner*—Stephen Cronin
*Attorney, Agent, or Firm*—Novak Druce Herrmann Burt

[57] ABSTRACT

A beverage can holder having a flat top member with a protrusion having groove for engaging the top rim of a beverage can, a central elongated body having a bulbous upper section and a flat lower section to provide a grip conformable to the user's hand, and a base member with a flat bottom and first and second curving backs for engagement with the bottom and side of the beverage can. The beverage can holder is releasably attached to the beverage can such that the beverage can is held at an angle to a flat surface. The novel method of attachment to a beverage can, and the novel shape of the beverage can holder allows the user to enjoy a beverage from a can as if the user was drinking from a stein or mug.

12 Claims, 1 Drawing Sheet

REUSABLE BEVERAGE CAN GRIP

BACKGROUND OF THE INVENTION

1) Field of the Invention

The present invention relates generally to beverage can holders, and more particularly to a reusable beverage can grip which releasably attaches to a beverage can and allows for a grip which generally conforms to the user's hand.

2) Description of the Related Art

Numerous handles have been brought forth from the inventive minds of those who consume beverages from beverage cans. Logan et al, U.S. Pat. No. 4,127,915 is such an invention. Logan discloses a snap lock handle for releasable connection to a conventional can such that when the handle is attached, the user may drink from the can in the manner as drinking from a mug. DeMars, U.S. Pat. No. 4,602,723 also discloses a handle for a beverage can, however, the DeMars handle receives the free end of a pull-tab of the can when attached to the can. The two handles of the previously mentioned patents are basically C-shaped handles which attach to beverage cans. What is needed is a beverage can handle which conforms to a user's grip so as to facilitate the gripping of the handle and drinking from the can.

Rose, U.S. Pat. No. 5,054,638, discloses a beverage can handle with a key ring attached which has a curved hand graspable portion which should enhance the gripping of the handle by a user. However, what is absent from the prior inventions is a handle designed to configure to a user's grip and palm, and have substantial universal application.

SUMMARY OF THE INVENTION

Accordingly, it is an object of the present invention to provide a beverage can grip that is easily engaged and disengaged with a beverage can.

It is a further object of the present invention to provide a beverage can grip which fits the palm of the user's hand.

It is a further object of the present invention to provide a beverage can grip which imitates the physical stimulation of gripping a stein.

Other objects and advantages will become apparent from the drawings, the detailed description of the invention, and the appended claims.

In order to achieve the above-stated objects, one embodiment of the present invention comprises a handle for releasable connection to a common beverage can with the handle comprising a handle body having a top connector and a bottom connector. The top connector is releasably connected with the top end of a beverage can and the bottom connector is releasably connected with a bottom end of a beverage can. A handle grip configured for conformance to a user's grasping hand is connected between the top and bottom connectors. The handle grip is configured such that when one connector is attached to one end of the beverage can, the other connector is positioned proximate to a location upon the opposite end of the beverage can for connection thereto.

The handle body has a bulbous upper handle grip portion for facilitating the user's grip, and a lower handle grip extension portion for locating the lower connector proximate to the lower end of the beverage can when the top connector is attached to the top end of the beverage can. The handle body also has a flexible joint connecting the bulbous upper handle portion to the lower extension portion for accommodating different sized beverage cans, and a bottom flat extension connected to the lower end of the handle grip extension portion that projects below the bottom end of the beverage can. The handle body also has an upper extension portion for locating the top connector proximate to the top end of the beverage can when said bottom connector is attached to the bottom end of the beverage can. The connectors are designed such that they conform to the surfaces of the top and bottom ends of the beverage can for a snapping engagement therewith.

In an alternative embodiment, the present invention is a beverage can holder for use with a beverage can comprising a grippable handle having a flat top member, a central elongated member, and a base member. The flat top member has a forward end and rearward end, with the forward end having a protrusion portion extending perpendicularly downward. The protrusion portion has a groove for engaging with the rim of the beverage can. The central elongated member protrudes perpendicularly downward from the rearward end of the flat top member. The central elongated member has a bulging upper section nearest the flat top member and a flat lower section nearest the base member. The bulging inner section has a curved inner side for facilitating gripping by a user of the beverage can holder. The flat lower section is angled obtuse to its connection with the upper bulging section. The base member is connected to the flat lower section such that the base member is substantially parallel to the flat top member. The base member has a flat bottom, a first curving back and a second curving back. Both of the curving backs are constructed to engage the lower end of the cylindrical side of a beverage can with the flat bottom engaging the bottom of the beverage can.

In still another embodiment of the present invention, the upper bulging section of the central elongated member has a central aperture which provides for a beverage can holder of lesser weight. The shape of the central aperture corresponds to the shape of the upper bulging section.

The present invention also embodies a method for providing a temporary handle for a beverage can. The method comprises first providing a handle for releasable connection to a beverage can, the handle having a handle body with two connectors and a handle grip between the two connectors. Next, positioning the handle proximate to the beverage can so that the top connector contacts the surface of the top end of the beverage can. Next, snapping the top connector into releasable connection with the beverage can. Then, allowing the bottom connector to be positioned proximate to the bottom end of the can and snapping it into releasable connection with the bottom end of the beverage can.

The beverage can handle of the present invention is composed of a flexible, yet resilient material. In the preferred embodiment, the handle is composed of a plastic material, however, the handle could be composed of other flexible, resilient materials such as graphite, metals, and the like. The handle is designed to be utilized with standard beverage cans, however, the handle could be utilized with other cans such as oil cans, foodstuff cans, and the like.

BRIEF DESCRIPTION OF THE DRAWINGS

The present invention is further described in connection with the accompanying drawings, in which.

DETAILED DESCRIPTION OF THE INVENTION

Figure 1:
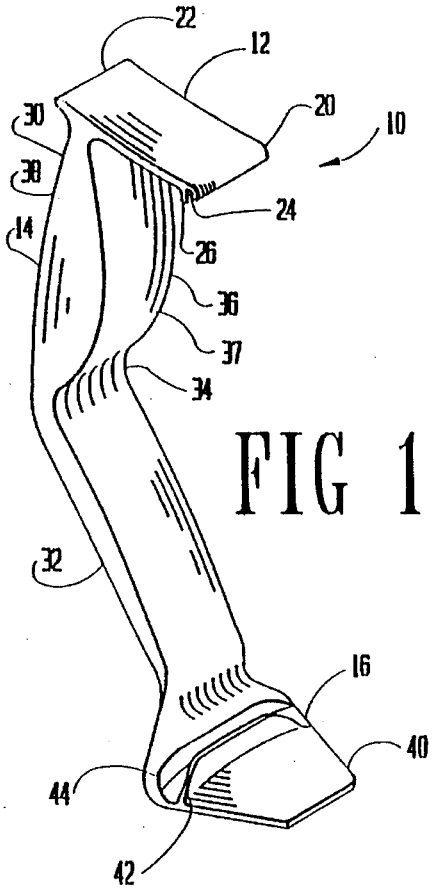
FIG. 1 is a front perspective of the reusable beverage can grip of the present invention.

There is illustrated in FIG. 1 a front perspective of the reusable beverage can grip of the present invention. In FIG. 1, the article of manufacture of the present invention is generally designated as beverage can holder 10. Holder 10 is comprised of flat top member 12, central elongated member 14 and base member 16. Flat top member 12 has forward end 20 and rearward end 22, with rearward end 22 connected to central elongated member 14. At forward end 20 of flat top member 12, there is protrusion portion 24 extending perpendicularly downward. Protrusion portion 24 has a groove 26 for engaging with a rim of a beverage can.

Central elongated member 14 has an upper section 30 and lower section 32 connected to each other at a flexible joint 34. In the preferred embodiment, lower section 32 is angled obtuse to upper section 30 at flexible joint 34. The actual angle of the lower section 32 to upper section 30 is one-hundred twenty degrees in the preferred embodiment. The inner side 36 of upper section 30 is bulbous, allowing for a beverage can holder which is designed to generally conform to the user's grip. The bulbous upper section 30 is substantially semi-elliptical with a midpoint 37 of the length of the upper section 30 being the farthest extension of the inner side 36 of the upper section 30. The outer side 38 of upper section 30 is smooth and flat so as to rest firmly in a user's palm. The obtuse angle of lower section 32 to upper section 30 allows for the flat top member 12 to be angled downward when holder 10 engaged with the beverage can 50 since flat top member 12 is substantially perpendicular to upper section 30.

Base member 16 is comprised of a flat bottom portion 40, a first curving back 42, and a second curving back 44. Base member 16 is connected to the lower end of lower section 32 of the central elongated member 14. Base member 16 is substantially parallel to flat top member 12. First curving back 42 and second curving back 44 are perpendicular to flat bottom 40 and provide an engagement means for releasably attaching to a standard beverage can. Flat bottom portion 40 will engage a portion of the bottom of beverage can 50 and raise the beverage can at a slight angle to a flat surface. The angle will correspond to the downward angle of the flat top member 12. In the preferred embodiment, the angle of lower section 32 to flat bottom portion 40 is one-hundred twenty-five degrees which allows for the beverage can holder 10 to easily attach to a beverage can 50 and then detach from the can 50.

Figure 2:
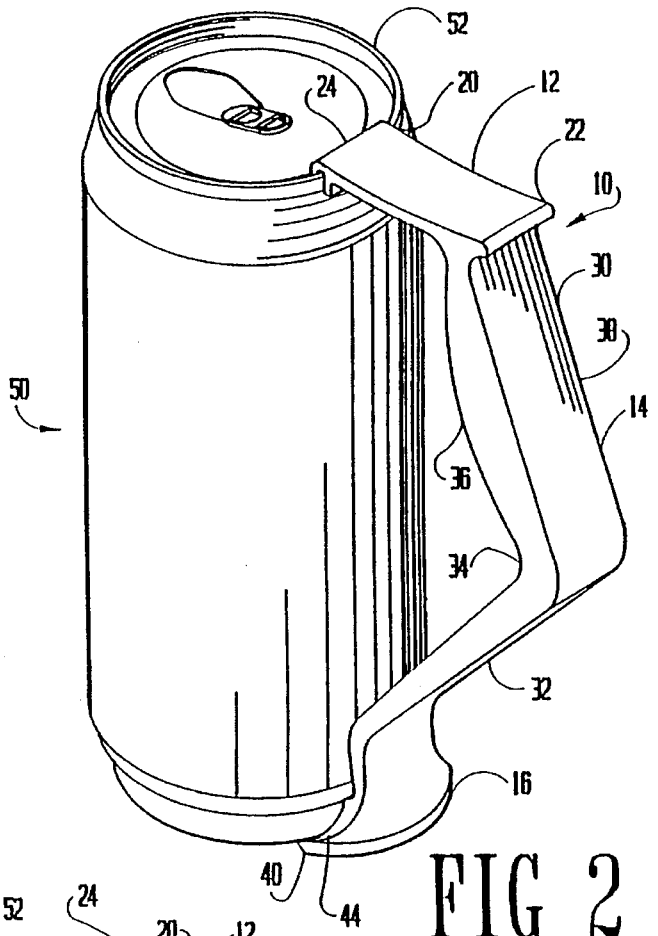
FIG. 2 is a top perspective of the reusable beverage can grip of the present invention engaged with a beverage can.
Figure 3:
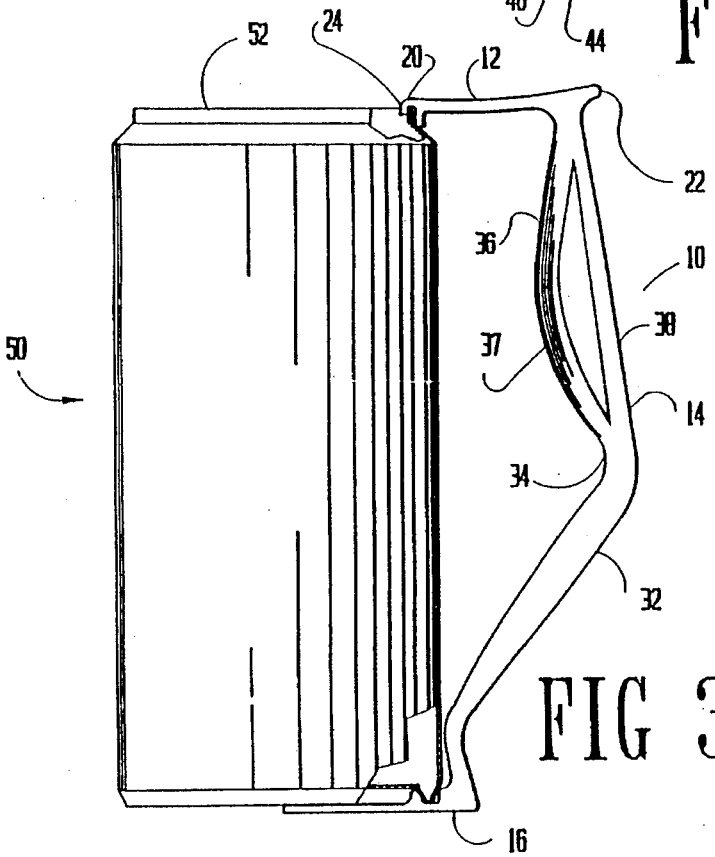
FIG. 3 is a side perspective of the reusable beverage can grip of the present invention engaged with a beverage can.

There is illustrated in FIGS. 2 and 3 the beverage can holder 10 of the present invention releasably attached to a standard beverage can 50. In FIGS 2 and 3, the rim 52 of can 50 is engaged with groove 26 of protrusion portion 24. The lower cylindrical side of can 50 is engaged with first curving back 42 and the bottom of the can 50 is placed upon the top of flat bottom portion 40. Once attached, holder 10 transforms standard beverage can 50 into a stein like mug for firm gripping by an user. This allows the user to drink a beverage in a can and enjoy it as if the user were drinking from a stein.

In use, holder 10 is positioned proximate to beverage can 50 such that rim 52 is easily snapped into engagement with groove 26 of protrusion portion 24. Then base member 16 is positioned proximate to the bottom end of the beverage can 50. Flat bottom portion 40 is slid underneath can 50 and the lower cylindrical side of can 50 is snapped into engagement with first curving back 42 or second curving back 44. Once all the contents in the can are consumed, or when the user is finished, holder 10 can be easily detached from can 50 through the reverse of the above-stated process. The beverage can holder 10 of the present invention is composed of a flexible, resilient material which allows for releasable attachment to the beverage can 50 without structurally damaging the holder 10.

While the preferred embodiment of the invention has been shown and described, it will be apparent to those skilled in this art that various modifications may be made in the embodiment without departing from the spirit of the present invention.

Therefore, the embodiments of the invention in which an exclusive property or privilege is claimed are defined as follows:

1. The handle for releasable connection to a beverage can, the handle comprising:

a handle body having a top connector and a bottom connector, said top connector releasably connectable with a top end of the beverage can and said bottom connector releasably connectable with a bottom end of the beverage can;

a handle grip connected between said top and bottom connectors, said handle grip configured for conformance to a user's grasping hand wherein said handle grip includes:

a bulbous upper handle grip portion for facilitating the user's grip;

a lower handle grip extension portion for locating the lower connector proximate to the lower end of the beverage can when said top connector is attached to the top end of the beverage can; and a flexible joint having a reduced thickness connecting said bulbous upper handle grip portion to said lower handle grip extension portion for accommodating different sized cans; and, said handle grip configured so that when one of said top and bottom connectors is attached to an end of the beverage can, the other connector is positioned proximate to a location upon an opposite end of the can for connection thereto.

2. The handle for releasable connection to a beverage can according to claim 1, wherein said bulbous upper handle grip portion is semi-elliptical at and inner side.

3. The handle for releasable connection to a beverage can according to claim 1, wherein said handle grip further comprising:

an upper extension portion for locating said upper connector proximate to the top end of the beverage can when said bottom connector is attached to the bottom end of the beverage can.

4. The handle for releasable connection to a beverage can according to claim 3, wherein said connectors conform to the surfaces of the top and bottom ends of the beverage can for snapping engagement therewith.

5. The handle for releasable connection to a beverage can according to claim 4, further comprising:

a bottom flat extension connected to a lower end of said lower handle grip extension portion that projects below the bottom end of the beverage can.

6. A beverage can holder for use with a cylindrical beverage can having a top rim and a bottom, the beverage can holder comprising: a grippable handle body having a flat top member, a central elongated member, and a base member; said flat top member having a forward end and a rearward end, said forward end having a protrusion portion extending perpendicularly downward, said protrusion portion having a groove for engaging with the top rim of the beverage can for attachment thereof; said central elongated member extending generally downward from said rearward end of said flat top member, said central elongated member having a bulbous upper section proximate to said flat top member and a flat lower section proximate to said base member, said bulbous upper section having a semi-elliptical inner side for facilitating gripping and a flat outer side, said flat lower section angled from its connection with said bulbous upper section; said bulbous upper section and said flat lower section connected by a flexible joint having a reduced thickness to thereby facilitate flexion at said joint; and, said base member connected to said flat lower section of said elongated member, said base member having a flat bottom, a first curving back and a second curving back, both said first curving back and said second curving back constructed to engage the lower end of the cylindrical side of the beverage can for attachment thereof, said flat bottom of said base member positioned under a portion of the bottom of the beverage can and raising that portion of the beverage can so as to slightly angle the beverage can; whereby the beverage can holder is releasably attached to the cylindrical beverage can through engagement of said groove of said protrusion portion with the top rim of the beverage can and through engagement of the lower cylindrical side and bottom of the beverage can with said first and second curving backs and said flat bottom, respectively.

7. The beverage can holder according to claim 6 wherein said bulbous upper section of said central elongated member has a central aperture therethrough allowing for a beverage can holder of lesser weight, said central aperture corresponding in shape to said bulbous upper section.

8. The beverage can holder according to claim 6 wherein the beverage can holder is composed of a flexible, resilient material allowing for releasable attachment of the beverage can holder to the beverage can.

9. The beverage can holder according to claim 6 wherein said bulbous upper section is angled obtuse to said flat lower section thereby allowing the beverage can to be held at an angle when attached to the beverage can holder.

10. The beverage can holder according to claim 6 wherein said flat lower section is angled obtuse to said base member thereby allowing the beverage can to be held at an angle when attached to the beverage can holder.

11. A method for providing a temporary handle upon a beverage can, comprising the following steps:

providing a handle for releasable connection to a beverage can, said handle comprising:

a handle body having two connectors, a top connector and a bottom connector;

said top connector releasably connectable with a top end of the beverage can and said bottom connector releasably connectable with a bottom end of the beverage can; and a handle grip connected between said top and bottom connectors, said handle grip configured for conformance to a user's grasping hand;

said handle grip having a bulbous upper section having a semi-elliptical inner side for facilitating gripping and a flat lower section;

said bulbous upper section and said flat lower section are coupled by a flexible joint having a reduced thickness;

positioning said handle proximate to the beverage can so that the top connector contacts a surface of the top end of the beverage can;

snapping said top connector into releasable connection with the beverage can;

allowing said lower connector to be positioned proximate to the bottom end of the beverage can as a result of the configuration of said handle; and snapping said lower connector into releasable connection with the bottom end of the beverage can.

12. The method for providing a temporary handle upon a beverage can as recited in claim 11, further comprising:

releasing said handle from the beverage can by unsnapping each end of said handle from the beverage can.

* * * * *